United States Patent [19]

Goyarts

[11] 4,445,663

[45] May 1, 1984

[54] ROTATING DEVICE FOR DRILL MAST

[75] Inventor: Wynand M. Goyarts, Washington, Pa.

[73] Assignee: Lee-Norse Company, Pittsburgh, Pa.

[21] Appl. No.: 371,007

[22] Filed: Apr. 22, 1982

[51] Int. Cl.[3] ..... F16M 11/10

[52] U.S. Cl. ..... 248/652; 248/371

[58] Field of Search ..... 248/652, 654, 371, 396

[56] References Cited

U.S. PATENT DOCUMENTS

| | | | |
|---|---|---|---|
| 3,711,047 | 1/1973 | O'Leary | 248/654 |
| 3,982,715 | 9/1976 | Lindgren | 248/654 |
| 4,000,873 | 1/1977 | Wallace | 248/654 |
| 4,232,850 | 11/1980 | Kimber | 248/654 |
| 4,265,147 | 5/1981 | Fox | 248/654 |
| 4,290,239 | 9/1981 | Zimmer | 248/654 |
| 4,364,540 | 12/1982 | Montabert | 248/654 |

*Primary Examiner*—R. P. Machado
*Assistant Examiner*—Alvin Chin-Shue
*Attorney, Agent, or Firm*—R. J. Falkowski

[57] ABSTRACT

A rotating device for a drill mast of a roof bolting mining machine has a pair of hydraulic cylinders respectively connected to appropriate ends of a lever arm. The hydraulic cylinders are connected at their respective other ends to the mast and to the mining machine. Full contraction of one cylinder rotates the lever arm which rotates the mast up to 45 degrees. Additional contraction of the other cylinder rotates the mast an additional 45 degrees.

8 Claims, 5 Drawing Figures

ROTATING DEVICE FOR DRILL MAST

This invention relates to roof bolting machines particularly to bolting machines that have a mast that is pivotable from a vertical to a horizontal position.

Roof bolting machines have drill masts that support drill motors and drill rods and are typically used to drill holes in roofs of mines and to insert roofing bolts into the holes. In these cases only vertical drilling is required. However, there are many applications in which it is desirable to rotate the mast from the full vertical to a horizontal position to enable drilling into the ribs or sidewalls of a mine. Such devices are available and usually accomplish rotation through known means such as chain drives.

With this invention a structure for rotating a mast between a vertical and a horizontal position is provided that is relatively simple in construction.

The objects and advantages of this invention will be apparent from the following description.

Figure 1:
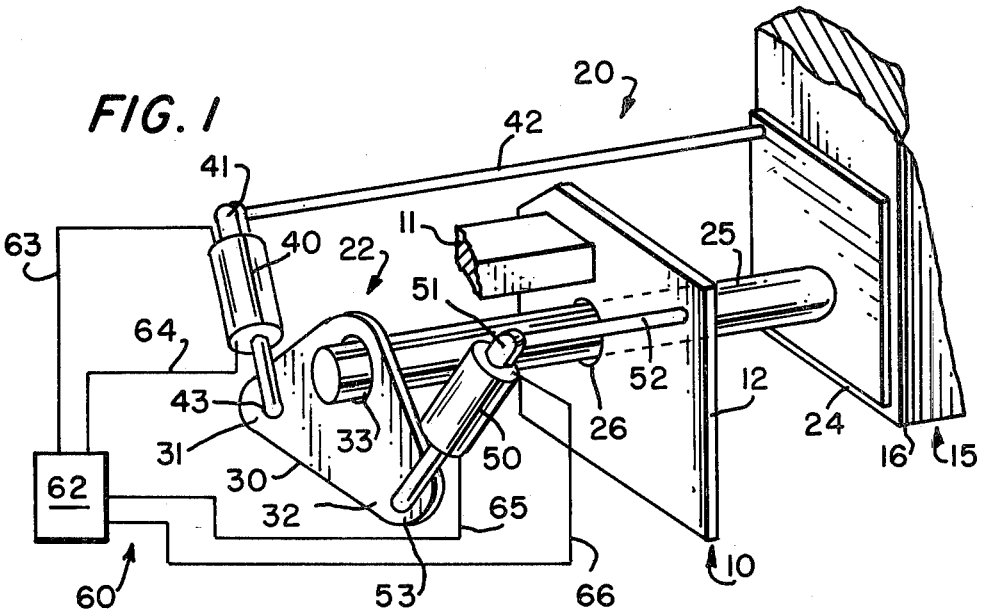
FIG. 1 is a simplified, schematic representation of a rotating assembly according to this invention.

Referring to FIG. 1 a roof bolting machine (shown in part) has a roof bolting machine base structure 10 has a support beam 11 that is part of the roof bolting machine and a support plate 12 connected to the support beam. A drill mast assembly 15 is supported by support plate 12 and comprises a drill mast support 16 that carries a drill box and drill rod (not shown) in any known manner.

A rotator means 20 for positioning drill mast assembly 15 at selected drilling angles comprises a pivot means 22 for connecting mast assembly 15 to the bolting machine support base structure 10 to be rotatble relative to the base structure about a pivot, a first hydraulic cylinder 40 and a second hydraulic clyinder 50, a linking arm 30, and a hydraulic means 60 for selectively expanding and contracting the hydraulic cylinders to thereby selectively rotate mast assembly 15.

Pivot means 22 comprises a conneacting plate 24 connected to support drill mast support 16 and a pivot rod 25 connected to connecting plate 24. Pivot rod 25 extends through support plate 12 to connecting plate 24 and is connected to rotate within a pivot bearing 26 in support plate 12 to support mast assembly 15 for rotation.

Linking arm 30 is connected to rotate about pivot rod 25 at a pivot connection 33 and has a first end 31 and a second end 32 selectively positioned to provide the lever distances and operation required.

Fist hydraulic cylinder 40 has a first end 41 connected to a connecting structure 42 which is connected to connecting plate 24 and a second end 43 connected to first end 31 of linking arm 30.

Second hydraulic cylinder 50 has a first end 51 connected to a connecting structure 52 and a second end 53 connected to second end 32 of linking arm 30.

Hydraulic means 60 is any known type and comprises controllable hydraulic source and sump 62 and appropriate hydraulic lines 63 and 64 connected to hydraulic cylinder 40 and appropriate hydraulic lines 65 and 66 connected to hydraulic cylinder 50 to control the expansion and contraction of the hydraulic cylinders.

Referring to FIGS. 2 through 5 which show an embodiment of the invention, a drill mast support 116 is connected through a pivot rod 125 to be supported by a support plate 112. A first hydraulic cylinder 140 has one end 141 connected by a connecting pivot bearing 142 to a connecting plate 124, and another end 143 connected to a first end 131 of a linking are 130 which pivots around a pivot bearing 133. A guide plate 146 and a spacing plate 145 guide the rotation.

A second hydraulic cylinger 150 has a first end 151 connected to support plate 112 and a second end 152 connected to a second end 132 of linking arm 130.

Figure 2:
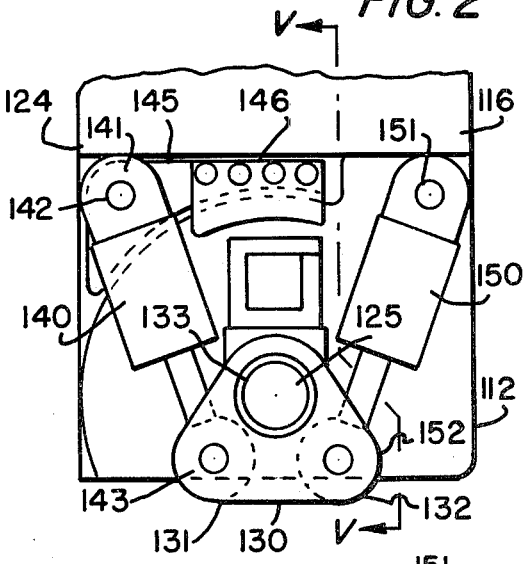
FIG. 2 is a front view of a rotating assembly according to this invention with the mast in a vertical position.
Figure 3:
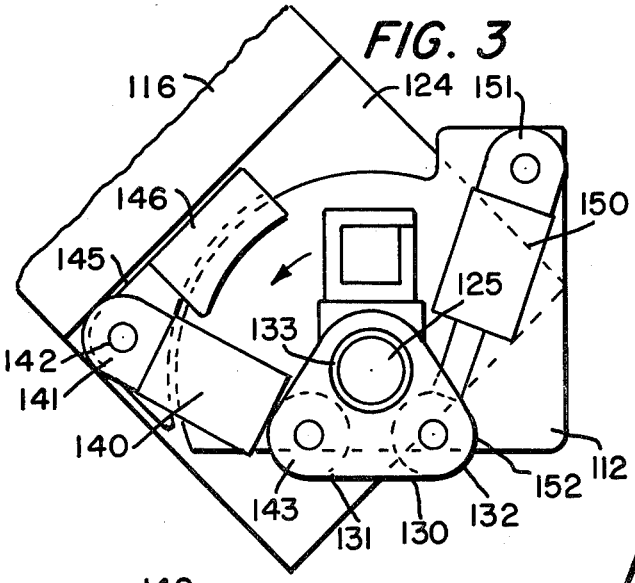
FIG. 3 is the assembly shown in FIG. 2 with the mast rotated 45 degrees.
Figure 4:
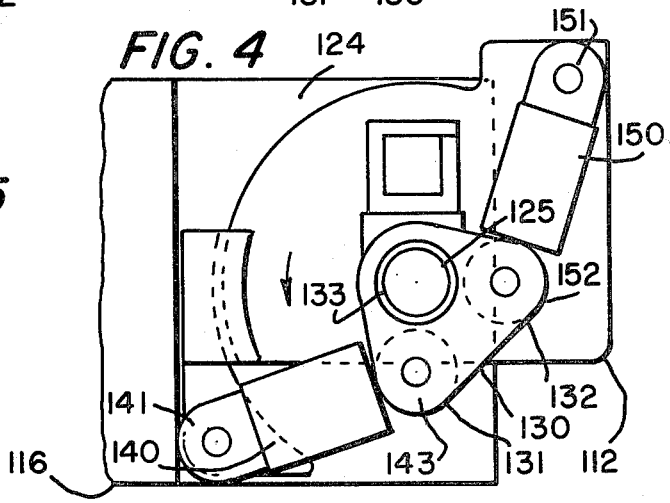
FIG. 4 is the assembly shown in FIG. 2 with the mast rotated to a horizontal position.
Figure 5:
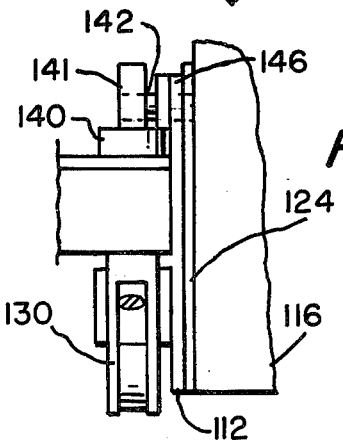
FIG. 5 is a partial end view taken along lines V—V in FIG. 2.

In the operation of the rotator means, referring to the Figures, starting with the vertical position of the mast assembly shown in FIGS. 1 and 2, hydraulic cylinder 40 (140) is contracted by the hydraulic means in any manner known in the art to the position shown in FIG. 3. This moves mast assembly 15 (116) to a position 45 degrees from the vertical. When it is desired to move the mast assembly beyond the 45 degree position hydraulic cylinder 50 (150) is contracted to move the drill mast assembly to the horizontal position shown in FIG. 4.

Selectively contracting and expanding the hydraulic cylinders can position the mast assembly in any of the intermediate positions between the vertical and horizontal position. Appropriate selection of the lever arm size and hydraulic cylinder travel distances enables rotation beyond 90 degrees if desired.

I claim:

1. A rotator means for positioning at selected drilling angles a drill mast for a roof bolting mining machine having a drill mast assembly and a support structure, said rotator means comprising:

a pivot means for connecting the mast assembly to the support structure to be rotatable relative to the support structure about a pivot;

a second expandable cylinder having one end connected to the support structure;

a first expandable cylinder having one end connected to the mast assembly;

a lever arm having one end connected to the other end of the first cylinder, another end connected to the other end of the second cylinder, and a pivot connection positioned between the first and second end connecting the lever arm to the support structure, and a pressure means for selectively expanding the cylinders to thereby selectively rotate the mast assembly.

2. A rotator means according to claim 1 wherein the cylinders are hydraulic cylinders and are expandable by an amount selected, and the lever arm ends are positioned, to enable selected rotating of the drill mast assembly from and between a horizontal and a vertical position.

3. A rotator means according to claim 2 wherein the support structure comprises a support plate and the second hydraulic cylinder is connected to the support plate.

4. A rotator means according to claim 3 wherein the pivot means comprises a pivot rod supported by the support plate and connected to the mast assembly.

5. A rotator means according to claim 4 wherein the pivot connection of the lever arm is connected to pivot about the pivot rod.

6. A rotator means according to claim 1 wherein the support structure comprises a support plate and the second cylinder is connected to the support plate.

7. A rotator means according to claim 6 wherein the pivot means comprises a pivot rod supported by the support plate and connected to the mast assembly.

8. A rotator means according to claim 7 wherein the pivot connection of the lever arm is connected to pivot about the pivot rod.

* * * * *